US005158387A

United States Patent [19]

Davies

[11] Patent Number: 5,158,387

[45] Date of Patent: Oct. 27, 1992

[54] BINDER CONSTRUCTION

[76] Inventor: Alan F. Davies, 5343 Yew Street, Apt. 401, Vancouver, BC, Canada, V6N 3X7

[21] Appl. No.: 794,716

[22] Filed: Nov. 15, 1991

[51] Int. Cl.[5] ..... B42F 13/00

[52] U.S. Cl. ..... 402/76; 402/73; 402/31

[58] Field of Search ..... 402/76, 73, 74, 77, 402/78, 29, 31, 42, 36

[56] References Cited

U.S. PATENT DOCUMENTS

| | | | |
|---|---|---|---|
| 1,825,360 | 9/1931 | McMillan | 402/76 |
| 2,246,763 | 6/1941 | Schlosser | 402/76 X |
| 2,365,643 | 12/1944 | Martin | 402/76 X |
| 2,891,553 | 6/1959 | Acton | 402/76 X |
| 2,976,871 | 3/1961 | Potts | 402/76 X |

FOREIGN PATENT DOCUMENTS

| | | | |
|---|---|---|---|
| 1264515 | 2/1972 | United Kingdom | 402/76 |

*Primary Examiner*—Timothy V. Eley

*Assistant Examiner*—Willmon Fridie, Jr.

*Attorney, Agent, or Firm*—J. Robert Cassidy

[57] ABSTRACT

A ring-type binder having a spine comprising inner and outer laminations of sheet material fixedly secured together in face-to-face relation, a ring-type binder element secured to the inner spine lamination by at least two (2) threaded fasteners extending through the inner spine lamination and through the binder element and secured in place by T-nuts, front and rear piano-type hinge elements secured to the front and rear edges of the spine inner lamination by through fastener elements, and front and rear covers fixedly secured to respective ones of the front and rear piano-type hinge elements by through fasteners, wherein the outer spine lamination is totally devoid of through fasteners and/or fastener openings and completely overlies and conceals the threaded fasteners used to secure the ring-type binder element and the through fasteners used to secure the front and rear hinge elements to the spine inner lamination.

7 Claims, 3 Drawing Sheets

BINDER CONSTRUCTION

BACKGROUND OF THE INVENTION

1. Technical Field

The present invention relates to binders; and, more particularly, to ring binders of the type having a rigid or semi-rigid cover consisting of a spine, front and rear cover members hingedly connected to the spine, and a conventional ring-type metal binder element commonly referred to as "ring metals" having two (2), three (3) or more rings secured to the binder element in vertically spaced relation and adapted to be manually opened and closed in a conventional manner by actuating levers at the upper and lower ends of the binder element so as to enable documents to be mounted on, or removed from, the rings.

More specifically, the present invention relates to an improved ring-type binder construction of the foregoing type wherein the binder's spine is laminated in construction, employing an inner lamination to which the conventional binder element and any metal hinge elements are fixedly secured and an outer lamination which is permanently secured to the inner lamination in face-to-face relation therewith, thus totally concealing all fastener elements projecting through the inner lamination, presenting a totally smooth uninterrupted external spine surface suitable for applying identifying labels, tags or other cataloging information anywhere on the spine from top to bottom, and wherein the outer lamination is slightly wider than the inner lamination so as to extend beyond the front and back edges of the inner lamination, thus defining front and rear partially enclosed cavities for housing the interleaved portions and pin elements of conventional front and back metal hinges of piano-type construction.

2. Background Art

There are, of course, a wide range of conventional binder constructions available in the marketplace including, for example, ring-type and post-type binders. Typically, however, a ring-type binder includes a conventional metal two-ring or three-ring binder element which is secured to the binder's spine by means of rivets which are exposed on the outer surface of the spine. The front and rear covers of the binders are typically secured to the spine by means of hinges which sometimes take the form of "living hinges" and other times take the form of separate piano-type metal hinges secured to the adjacent vertical edges of the spine and the front and rear covers by rivets or other through-type fastening elements. In the case of "living hinges", the binder's spine is, therefore, generally characterized by the presence of exposed portions of the heads of the rivets used to secure the conventional ring-type binder element; and, where separate hinges are employed, the spine is generally characterized by the presence of exposed rivet heads or the heads of similar fasteners used to secure the hinges as well as by the heads of the rivets used to secure the conventional ring-type binder element.

Typically, however, the user of these types of ring-type binders desires to employ the exposed surface of the spine for cataloging information applied thereto in the form of labels, tags and the like; and, it has been found that the lack of a smooth, clear, uninterrupted surface on the exterior portion of the spine is undesirable and interferes with free application of such cataloging information anywhere on the spine that the user might desire.

SUMMARY OF THE INVENTION

The present invention overcomes the foregoing disadvantages by providing a simple, compact, rugged ring-type binder construction employing: (i) a rigid laminar spine having an inner lamination to which all requisite fastening elements for both the conventional ring-type binder element and separate hinges are secured, and a slightly wider outer lamination permanently bonded to the inner lamination in overlying relation to all fastening elements and providing front and rear partially enclosed cavities for housing the interleaved hinge elements and pins of conventional piano-type hinges; (ii) a conventional metal ring-type binder element fixedly secured to the spine's inner lamination by threaded fasteners; (iii) front and rear metal piano-type hinges secured to the spine's inner lamination with the interleaved hinge elements and pins lying in the front and rear partially enclosed cavities defined by the spine's inner and outer laminations; and (iv), front and rear covers secured along one edge to respective ones of the front and rear hinges by means of rivets or other suitable fastening elements. Thus, the arrangement is such that when assembled, the inner and outer spine laminations cooperate with the front and rear covers to form front and rear C-shaped channels or grooves which contain the interleaved hinge portions and hinge pins to provide a neat and attractive cover, wherein the outer spine lamination is totally devoid of through fasteners, thus providing a clean continuous uninterrupted external spine surface from top to bottom and from front to back suitable for application of any desired cataloging information. Such a construction has been found to be particularly suitable for use in hospitals and health care facilities wherein the health care providers are required to maintain a multiplicity of loose leaf records for each different patient, although the invention is not limited to application in such narrow restricted field.

DESCRIPTION OF THE DRAWINGS

These and other objects and advantages of the present invention will become more readily apparent upon reading the following detailed Description and upon reference to the attached drawings, in which.

Figure 1:
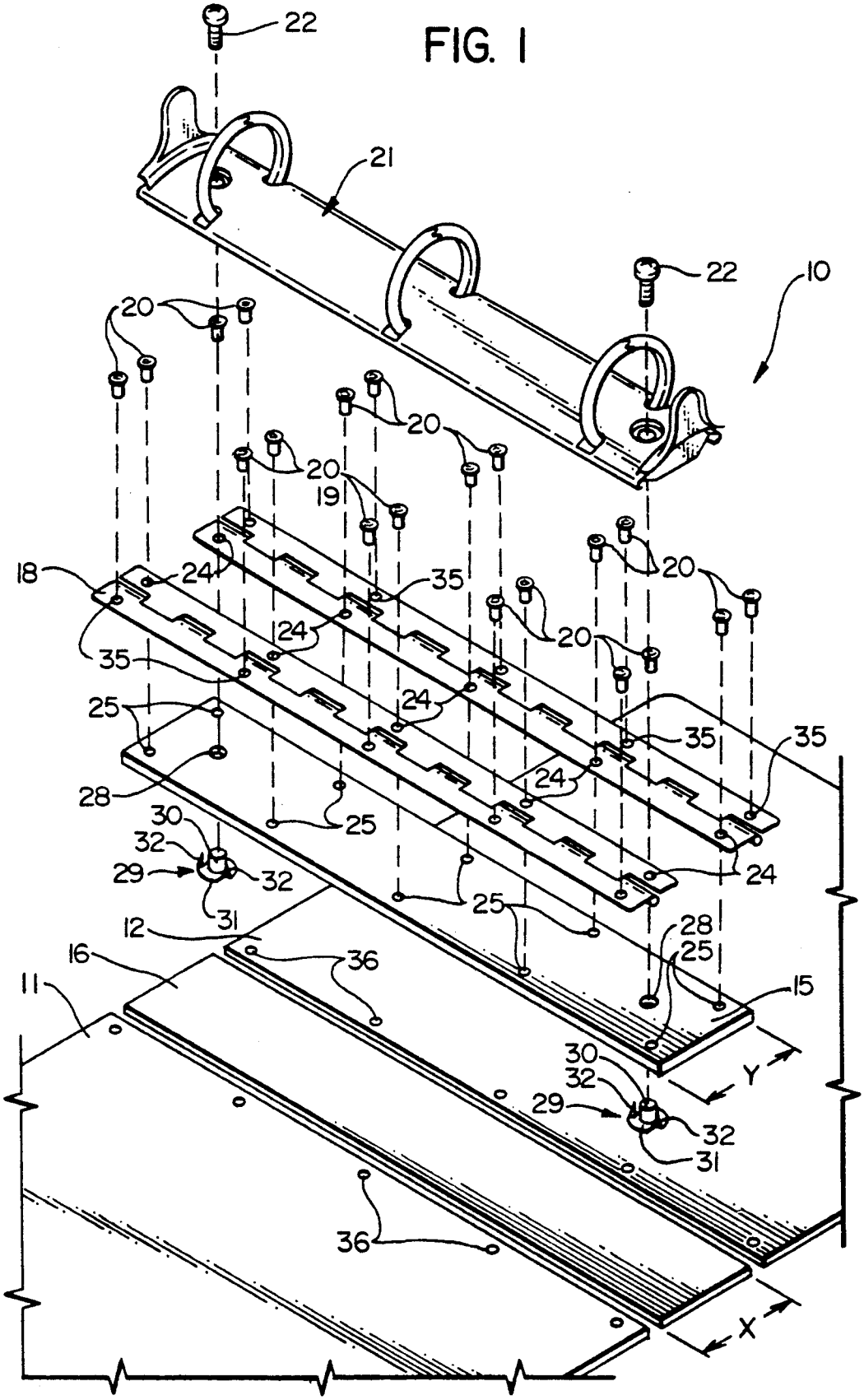
FIG. 1 is a fragmentary, exploded, isometric view here illustrating the discrete components from which a binder construction embodying features of the present invention can be assembled.

While the invention is susceptible of various modifications and alternative forms, a specific embodiment thereof has been shown by way of example in the drawings and will herein be described in detail. It should be understood, however, that it is not intended to limit the invention to the particular form disclosed but, on the contrary, the intention is to cover all modifications, equivalents and/or alternatives falling within the spirit and scope of the invention as expressed in the appended claims.

DETAILED DESCRIPTION

Turning now to the drawings, and as best illustrated by reference to FIGS. 1 and 5 conjointly, an exemplary three-ring binder, generally indicated at 10, embodying features of the present invention has been depicted. As here shown, the exemplary binder 10 includes: (i) a front cover 11 and a rear cover 12 preferably made of rigid or semi-rigid self-supporting plastic, fiberboard, wood, metal or similar material; (ii) a spine generally indicated at 14 in FIG. 5 and consisting of a rigid or semi-rigid inner lamination 15 preferably formed of sheet plastic material or the like and a rigid or semi-rigid outer lamination 16 preferably formed of the same material as the front and rear covers 11, 12; (iii) front and rear metal piano-type hinges 18, 19 adapted to be secured to the spine's inner lamination 15 by means of rivets 20 or similar fasteners; and (iv), a conventional three-ring metal binder element, generally indicated at 21, adapted to be secured to the spine's inner lamination 15 by threaded fasteners 22.

As indicated above, the particular materials from which the present invention is made can vary widely without departing from the spirit and scope of the invention as expressed in the appended claims. However, particularly advantageous results have been found where the front and rear covers 11, 12 end and the outer spine lamination 16 are made of foam core PVC (polyvinylchloride) which is available in a wide variety of aesthetically pleasing colors; while the inner spine lamination 15 to which the ring metals 21 and hinges 18, 19 are secured is preferably formed of high impact ABS plastic, thereby rendering binders 10 made with such materials highly resistant to damage resulting from inadvertent dropping thereof.

Figure 2:
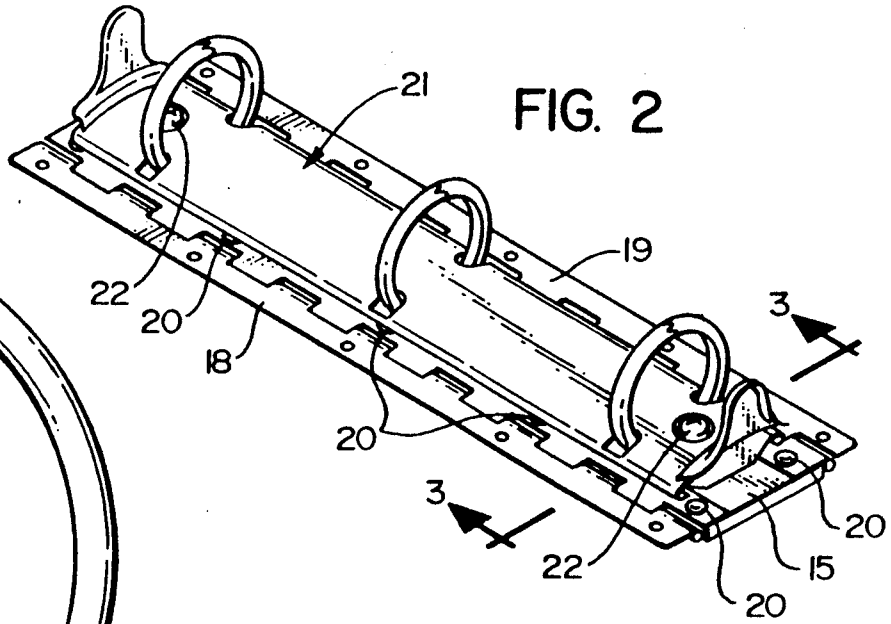
FIG. 2 is an isometric view here illustrating a conventional metal three ring binder element and front and rear hinge elements secured to the inner lamination of a laminar spine in accordance with the present invention.
Figure 3:
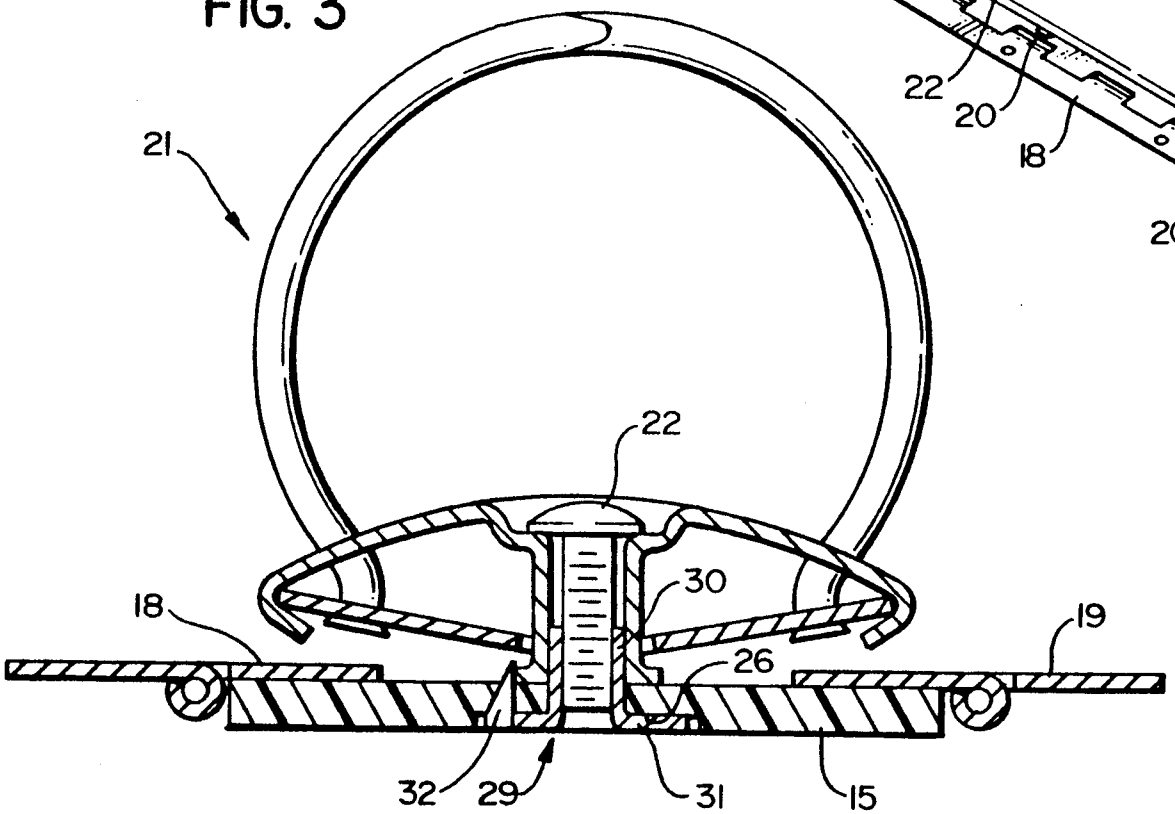
FIG. 3 is a sectional view taken substantially along the line 3—3 in FIG. 2.

In assembly of the binder, and as best shown by initial reference to FIGS. 2 and 3 conjointly, the front and rear hinges 18, 19 are fixedly secured to the spine's inner lamination 15 by means of rivets 20 passing through a first set of registered openings 24, 25 formed in the hinges 18, 19 (openings 24) and inner lamination 15 (openings 25). To secure the exemplary three-ring binder element 21 to the inner spine lamination 15, the lamination 15 is provided on its outer surface with a pair of recessed depressions or cutouts, one of which is depicted at 26 in FIG. 3, respectively concentric with a pair of through bores 28 formed in the inner lamination 15. A T-nut, generally indicated at 29 n FIG. 1, having an internally threaded central post 30 and a flat head 31 with a plurality of right angular sharpened prongs 32, is seated within each recessed depression 26 in the inner spine lamination 15, with the sharpened prongs 32 being projected through the spine lamination 15 to securely seat the T-nut 29 and prevent rotation thereof. As a consequence of this construction, the conventional three-ring binder element 21 can be securely fastened to the spine's inner lamination 15 by means of the threaded fasteners 22 which extend through the binder element 21 and are threadably received within the internally threaded posts 30 on the T-nuts 29.

Figure 4:
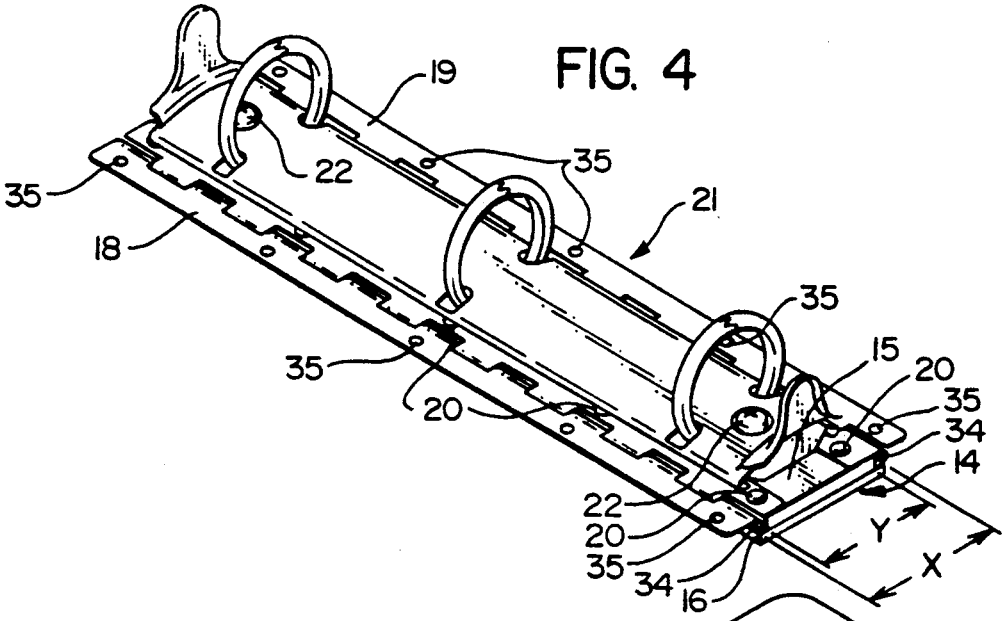
FIG. 4 is an isometric view similar to FIG. 2, but here depicting the assembly after application of the spine's outer lamination; and, FIG. 5 is a fragmentary isometric view depicting a three-ring binder, fully assembled in accordance with the invention, but with the front and back covers open and lying in a common plane so as to expose the internal portions of the binder assembly.
Figure 5:
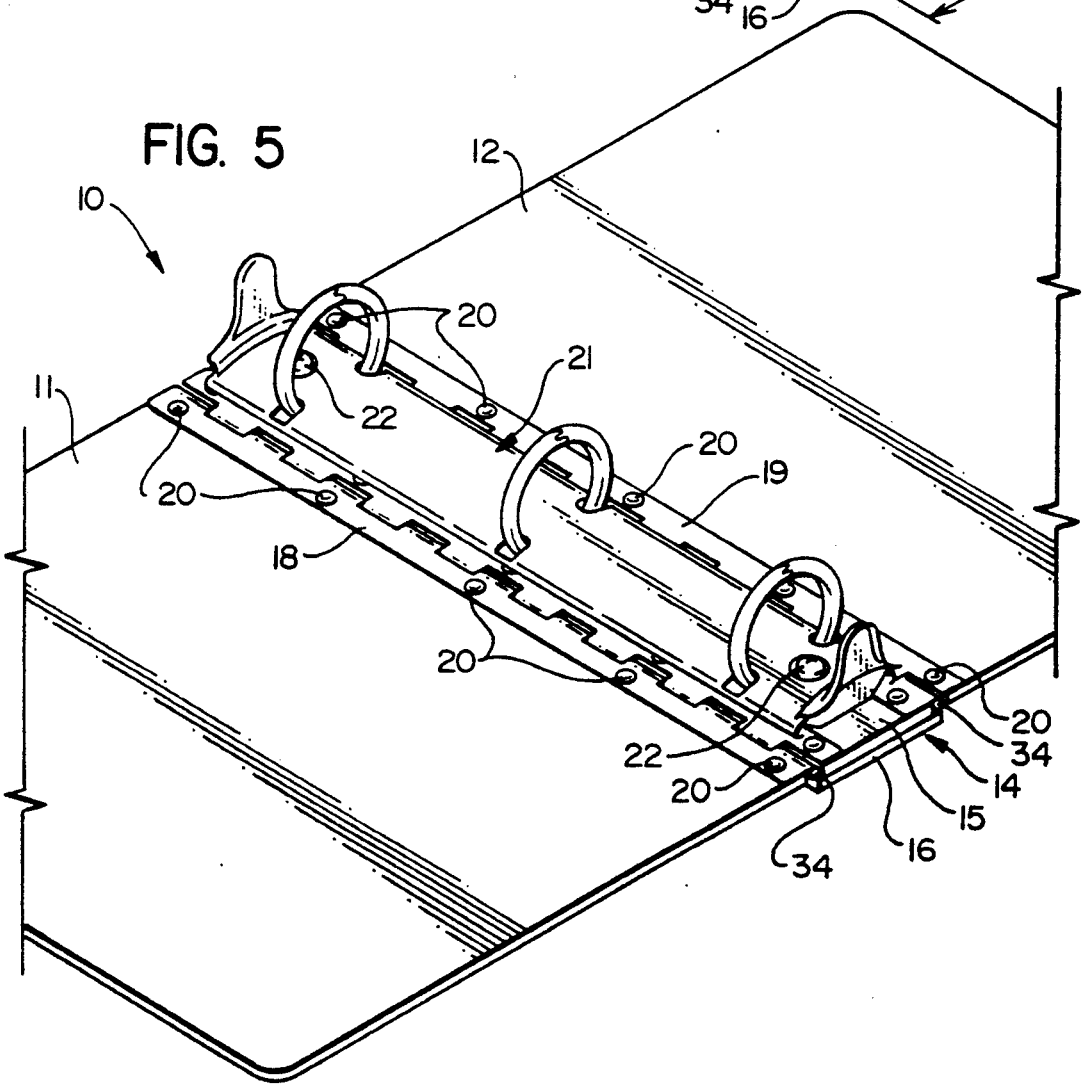

Considering next FIGS. 1, 4 and 5 conjointly, it will be noted that the outer lamination 16, which is completely devoid of threaded fasteners and/or fastener openings of any kind (FIG. 1), has a width "X" which is slightly greater than the width "Y" of the inner lamination 15; and, consequently, when the two laminations 15, 16 are bonded together in face-to-face relation, partially enclosed channels 34 (FIGS. 4 and 5) are formed along the front and rear edges of the spine 14, which channels are capable of receiving the interleaved hinge portions and hinge pins of the front and rear hinges 18, 19. Moreover, when the front and rear covers 11, 12 are secured to respective ones of the front and rear hinges 18, 19 by rivets 20 passing through registered openings 35, 36 in the hinges 18, 19 (openings 35) and covers 11, 12 (openings 36), the front and rear covers 11, 12 cooperate with the inner and outer laminations 15, 16 of the spine 14 to form front and rear C-shaped channels 34 (FIG. 5) adapted to substantially enclose the interleaved hinge portions and hinge pins of the hinges 18, 19, thereby protecting both the hinge elements and those surfaces on which the binder resides during usage.

The particular widths "X" and "Y" of the outer and inner spine laminations 16, 15 will, of course, vary dependent upon the size of the binder; and, such actual dimensions form no part of the present invention. However, merely by way of example, where the binder is a one and one-half inch (1½) binder, the outer lamination 16 preferably has a width "X" approximately equal to one and three-quarter inches (1¾), while the inner lamination 15 has a width "Y" approximately equal to one and seven-sixteenths inches (1-7/16″). Similarly, in a two inch (2″) binder, the outer lamination 16 preferably has a width "X" on the order of approximately two and one-quarter inches (2¼), while the inner lamination preferably has a width "Y" on the order of approximately one and fifteen-sixteenths inches (1-15/16″).

Any suitable non-intrusive fastening means can be employed to secure the inner and outer laminations 15, 16 of the spine 14 together in face-to-face relation. For example, when the laminations 15, 16 are formed of plastic, suitable plastic adhesive or plastic bonding techniques can be employed; when formed of wood or fiberboard, suitable wood adhesives can be employed; or, when formed of metal, the parts can be bonded by any suitable metal adhesive or they can be spot welded together.

Thus, those persons skilled in the art will appreciate that when fully assembled as shown in FIG. 5, a binder 10 made in accordance with the present invention will be characterized by its strength, rigidity, cleanness of lines and appearance, and protection of its hinges; yet, the spine 14 when viewed from the outside of the binder will appear to be totally devoid of any rivets, threaded fasteners or like securement means of the type commonly employed in assembly of such binders. Therefore, the entire exterior surface of the outer lamination 16 of the spine 14 can be used for the application of any desired cataloging information.

I claim:

1. A binder construction comprising, in combination:

(a) a binder spine inner lamination having front and rear spaced apart parallel vertical edges, said spine inner lamination being formed of self-supporting material and having formed therein at least a pair of through openings terminating in recessed depressions formed in the outer surface of said inner lamination;

(b) front and rear metal hinge elements, said hinge elements being fixedly secured to said spine inner lamination adjacent respective ones of said front and rear edges of said spine inner lamination by fasteners extending through each of said hinge elements and through the front and rear edges of said spine inner lamination;

(c) a front cover fixedly secured to said front hinge element by fasteners extending through said front hinge element and through one edge of said front cover;

(d) a rear cover fixedly secured to said rear hinge element by fasteners extending through said rear hinge element and through one edge of said rear cover;

(e) a metal ring binder, said metal ring binder being fixedly secured to said spine inner lamination by means of at least a pair of threaded fasteners and cooperable threaded T-nuts, said T-nuts each having an internally threaded center post extending through one of said through openings in said spine inner lamination and an enlarged head non-rotatably secured in one of said recessed depressions; and, (f) a smooth, clear, uninterrupted spine outer lamination totally devoid of fasteners and/or fastener openings, said spine outer lamination being permanently bonded to said spine inner-lamination in face-to-face overlying relation to those of said hinge fasteners and said threaded fasteners passing through said spine inner-lamination so as to permit application of cataloging information to the outer exposed surface of said spine outer lamination anywhere from top-to-bottom and front-to-back thereof.

2. A binder construction as set forth in claim 1 wherein said metal hinge elements are piano-type hinges having interleaved portions secured together by a hinge pin, said spine outer lamination is wider than said spine inner lamination, and said inner and outer spine laminations cooperate with said front and rear covers to form front and rear C-shaped channels for housing said interleaved hinge portions and hinge pins of respective ones of said front and rear hinge elements.

3. A binder construction as set forth in claim 1 wherein said T-nut enlarged head includes integral sharpened prongs normal to said head and parallel to said center post, said prongs being projected through said spine inner lamination for non-rotatably securing said T-nut to said inner lamination.

4. A binder construction as set forth in claim 1 wherein said front and rear covers and said spine outer lamination are formed of foam core PVC.

5. A binder construction a set forth in claim 1 wherein said spine inner lamination is formed of high impact ABS plastic.

6. A binder construction as set forth in claim 5 wherein said front and rear covers and said spine outer lamination are formed of foam core PVC.

7. A binder construction as set forth in claim 6 where said fasteners used to secure said hinge elements to said spine inner lamination are rivets.

* * * * *